US008776739B2

(12) United States Patent
Cleeves et al.

(10) Patent No.: US 8,776,739 B2
(45) Date of Patent: Jul. 15, 2014

(54) INTERNAL COMBUSTION ENGINE VALVE ACTUATION AND ADJUSTABLE LIFT AND TIMING

(75) Inventors: James M. Cleeves, Redwood City, CA (US); Michael Hawkes, San Francisco, CA (US)

(73) Assignee: Pinnacle Engines, Inc., San Carlos, CA (US)

( * ) Notice: Subject to any disclaimer, the term of this patent is extended or adjusted under 35 U.S.C. 154(b) by 121 days.

(21) Appl. No.: 13/270,173

(22) Filed: Oct. 10, 2011

(65) Prior Publication Data

US 2012/0111293 A1 May 10, 2012

Related U.S. Application Data

(63) Continuation of application No. PCT/US2011/055500, filed on Oct. 8, 2011.

(60) Provisional application No. 61/391,476, filed on Oct. 8, 2010, provisional application No. 61/501,654, filed on Jun. 27, 2011.

(51) Int. Cl.
*F01L 1/34* (2006.01)

(52) U.S. Cl.
USPC ..... 123/90.16; 123/90.18

(58) Field of Classification Search
USPC ..... 123/90.15, 90.17, 90.18, 90.39
See application file for complete search history.

(56) References Cited

U.S. PATENT DOCUMENTS 1,502,291 A * 7/1924 Conway ..... 123/51 AA
4,352,344 A * 10/1982 Aoyama et al. ..... 123/90.18
4,643,141 A 2/1987 Bledsoe
4,721,007 A 1/1988 Entzminger
4,723,515 A 2/1988 Burandt
7,559,298 B2 7/2009 Cleeves
2003/0127063 A1 7/2003 Wang
2005/0211203 A1 9/2005 Roth (Continued)

FOREIGN PATENT DOCUMENTS

DE 4227392 A1 3/1993
DE 4243169 C1 5/1994

(Continued)

OTHER PUBLICATIONS

International Search Report and Written Opinion dated Feb. 8, 2012, for PCT Application No. PCT/US2011/055500.

(Continued)

*Primary Examiner* — Zelalem Eshete
(74) *Attorney, Agent, or Firm* — Mintz Levin Cohn Ferris Glovsky and Popeo, P.C.

(57) ABSTRACT

A cam can rotate on a camshaft of an internal combustion engine. A rocker arm that actuates a valve of the internal combustion engine can include a rocker pivot connection point located on a distal side of a valve component from a proximate end of the rocker arm that is deflected by action of the cam. The rocker arm can include a contact point located between the rocker pivot point and the proximate end. The contact point can act on the valve component to actuate the valve. The rocker pivot connection point can be translated such that it is closer to or further from the cam. This translation can be used to vary valve lift and/or valve timing. The cam can have a three-dimensional profile to provide different actuation distance of the rocker arm. Systems, methods, and articles of manufacture consistent with one or more of these features are described.

20 Claims, 15 Drawing Sheets

(56) References Cited

U.S. PATENT DOCUMENTS

| | | | |
|---|---|---|---|
| 2006/0047350 | A1 | 3/2006 | Yasui et al. |
| 2007/0144474 | A1 | 6/2007 | Kitagawa et al. |

FOREIGN PATENT DOCUMENTS

| | | | |
|---|---|---|---|
| DE | 102008063337 | A1 | 11/2009 |
| GB | 1516982 | A | 7/1978 |
| GB | 2432398 | A | 5/2007 |
| JP | 2123215 | A | 5/1990 |

OTHER PUBLICATIONS

International Search Report and Written Opinion dated Mar. 25, 2013, for PCT Application No. PCT/US2011/055500.

* cited by examiner

300

INTERNAL COMBUSTION ENGINE VALVE ACTUATION AND ADJUSTABLE LIFT AND TIMING

CROSS-REFERENCE TO RELATED APPLICATIONS

The current application is a continuation under 35 U.S.C. §120 of Patent Cooperation Treaty Application No. PCT/US2011/055500 filed on Oct. 8, 2011 and entitled "Internal Combustion Engine Valve Actuation and Adjustable Lift and Timing", which claims priority under 35 U.S.C. §119(e) to U.S. provisional patent application Ser. No. 61/391,476 filed on Oct. 8, 2010 and entitled "Internal Combustion Engine Valve Actuation and Adjustable Lift and Timing," and to U.S. provisional patent application Ser. No. 61/501,654 filed on Jun. 27, 2011 and entitled "High Efficiency Internal Combustion Engine".

The current application is also related to co-owned U.S. Pat. No. 7,559,298, to co-owned and co-pending international application no. PCT/US2011/055457 entitled "Single Piston Sleeve Valve with Optional Variable Compression Ratio Capability," and to co-owned and co-pending international application no. PCT/US2011/055485 entitled "Positive Control (Desmodromic) Valve Systems for Internal Combustion Engines." The disclosure of each of the documents identified in this and the preceding paragraph is incorporated by reference herein in its entirety.

TECHNICAL FIELD

The subject matter described herein relates generally to internal combustion engines and in particular to operation of valves controlling inlet and/or exhaust ports in such engines.

BACKGROUND

Internal combustion engines generally include one or more pistons that move in a reciprocal motion within each of one or more cylinders defined by an engine block or other engine structure. Air and/or fuel are delivered to a combustion chamber within each cylinder by one or more inlet ports and exhaust gases are removed from the combustion chamber within each cylinder by one or more exhaust ports. Control over the opening and closing of inlet and exhaust ports is generally provided by one or more valves, which can be reciprocating poppet valves, sleeve valves, or the like.

Poppet valves include a tapered valve head that plugs a hole and a valve stem extending from the valve head to guide and/or actuate motion of the valve head for opening and closing of the valve. In internal combustion engines with a single piston per cylinder, two or more poppet valves positioned in the cylinder head opposite the piston crown are commonly used to control opening and closing of intake and exhaust ports. Some single piston per cylinder engine configurations, for example those described in co-owned and co-pending international application no. PCT/US2011/055457 include sleeve valves, as do opposed piston engines such as those described in co-owned U.S. Pat. No. 7,559,298.

A sleeve valve typically forms all or a portion of the cylinder wall. In some variations, the sleeve valve reciprocates back and forth along its axis to open and close intake and exhaust ports at appropriate times to introduce air or fuel/air mixture into the combustion chamber and to exhaust combustion products from the chamber. In other variations, the sleeve valve can rotate about its axis to open and close the intake and exhaust ports.

SUMMARY

In one aspect, a system includes a cam that rotates on a camshaft of an internal combustion engine and a rocker arm that actuates a valve of the internal combustion engine. The rocker arm includes a rocker pivot connection point located on a distal side of a valve component from a proximate end of the rocker arm that is deflected by action of the cam. The rocker arm includes a contact point located between the rocker pivot point and the proximate end. The contact point acting on the valve component to actuate the valve.

In an interrelated aspect, a method includes rotating a cam of an internal combustion engine by causing rotation of a camshaft upon which the cam is mounted, and actuating a valve of the internal combustion engine by motion of a rocker arm. The rocker arm includes a rocker pivot connection point located on a distal side of a valve component from a proximate end of the rocker arm that is deflected by action of the cam. The rocker arm further includes a contact point located between the rocker pivot point and the proximate end. The contact point acts on the valve component to actuate the valve.

In some variations one or more of the following features can optionally be included in any feasible combination. A pivot connection point translation system can optionally be included to cause the pivot connection point to move closer to or farther from the cam according to a throttle input received from a throttle control device. Moving the pivot connection point closer to the cam can optionally result in reducing an amount of lift experienced by the valve off a valve seat under actuation by the rocker arm, and moving can optionally result in the pivot connection point farther from the cam results in increasing the amount of lift experienced by the valve off the valve seat under actuation by the rocker arm. Moving the pivot connection point closer to the cam can optionally result in an earlier actuation of the valve under actuation by the rocker arm and moving the pivot connection point farther from the cam can optionally result in a delayed actuation of the valve under actuation by the rocker arm. The cam can optionally include a three-dimensional cam profile that can include at least two cam profiles that result in differing deflection distances of the proximate end of the rocker arm. The three-dimensional cam profile can optionally further include a continuously variable cam profile. The proximate end of the rocker arm can optionally include a rotatable follower that rotates relative to the rocker arm in response to interacting with the at least two cam profiles. The proximate end of the rocker arm can optionally include a follower that interacts with the cam. The valve can optionally include a sleeve valve or a poppet valve.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Regardless of the valve type used in an internal combustion engine and also largely independent of the type of engine, some form of reciprocating valve that is moved between an opened and a closed position in a reciprocating motion is generally used open and close intake and exhaust ports at appropriate times during the engine cycle. Commonly used valve actuation systems typically rely on a camshaft for valve opening and a spring for valve closure. Yet other systems utilize hydraulic or pneumatic systems for valve actuation. Regardless of what type of valve actuation system an engine uses, opening and closing intake and exhaust valves presents a number of challenges to provide desirable characteristics of timing, lift, duration, sealing, producibility, serviceability, etc.

A cam is a rotating or sliding piece in a mechanical linkage that transforms rotary motion (e.g. of a camshaft) into linear motion or vice-versa. A cam is generally part of a part of a rotating wheel (e.g. an eccentric wheel) or a camshaft (e.g. a cylinder with an irregular shape) that strikes a lever at one or more points on its circular path. A cam follower, also known as a track follower, is a specialized type of roller or needle bearing designed to follow cams. In internal combustion engines with pistons, one or more camshafts can be used to operate intake and exhaust valves that conduct combustion fluids (e.g., air and/or fuel) and exhaust gases to and from the combustion chamber or chambers of an engine. The cams force the valves open by pressing on the valve, or on some intermediate mechanism (e.g. a rocker or rocker arm) as they rotate.

A rocker or rocker arm is generally a reciprocating lever that conveys radial movement from a cam lobe into linear movement at a valve to open and/or close it. One end of a rocker arm is raised and lowered by a rotating lobe or lobes of the camshaft (either directly or via a tappet or lifter and pushrod) while the other end acts on the valve. When the cam lobe raises the outside of the arm, the inside presses on the valve, thereby opening the valve. When the outside of the arm is permitted to return due to rotation of the camshaft, the inside rises, allowing the valve spring to close the valve. The effective leverage of the arm (and thus the force it can exert on the valve) is determined by the rocker arm ratio, the ratio of the distance from the center of rotation of the rocker arm to the tip divided by the distance from the center of rotation to the point acted on by the camshaft or pushrod.

Figure 1:
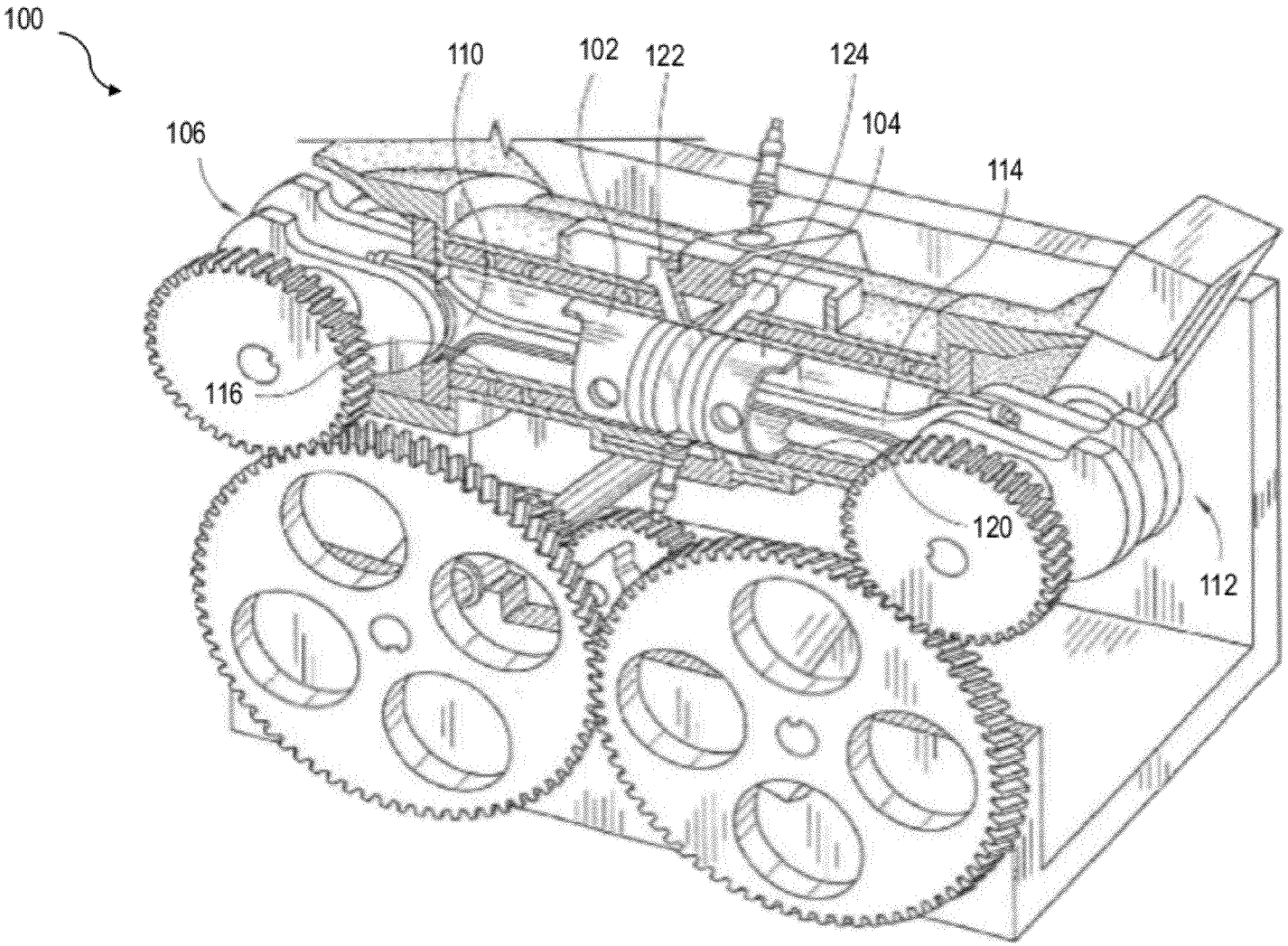
FIG. 1 shows a cutaway diagram of part of an internal combustion engine in which two opposed pistons move reciprocally within a cylinder.

FIG. 1 shows a partially cut away isometric view of an internal combustion engine 100 having a pair of opposing pistons that includes a first piston 102 and a second piston 104. The first piston 102 is operably coupled to a first crankshaft 106 by a first connecting rod 110 and the second piston 104 is operably coupled to a second crankshaft 112 by a second connecting rod 114. As shown in FIG. 1, the first crankshaft 106 is operably coupled to the second crankshaft 112 by a series of gears that synchronize or otherwise control motion of the first piston 102 and second piston 104. During engine operation, the first piston 102 and the second piston 104 reciprocate toward and away from each other in coaxially aligned cylindrical bores formed by corresponding sleeve valves. More specifically, the first piston 102 reciprocates back and forth in an exhaust sleeve valve 116, while the second piston 104 reciprocates back and forth in a corresponding intake sleeve valve 120. The exhaust sleeve valve 116 and the intake sleeve valve 120 can also reciprocate back and forth to open and close a corresponding exhaust port 122 and inlet port 124, respectively, at appropriate times during the engine cycle to deliver air and/or fuel to a combustion chamber 126 defined at least in part by the bodies of the exhaust and intake sleeve valves 116, 120 and the heads of the first and second pistons 102, 104.

Figure 2:
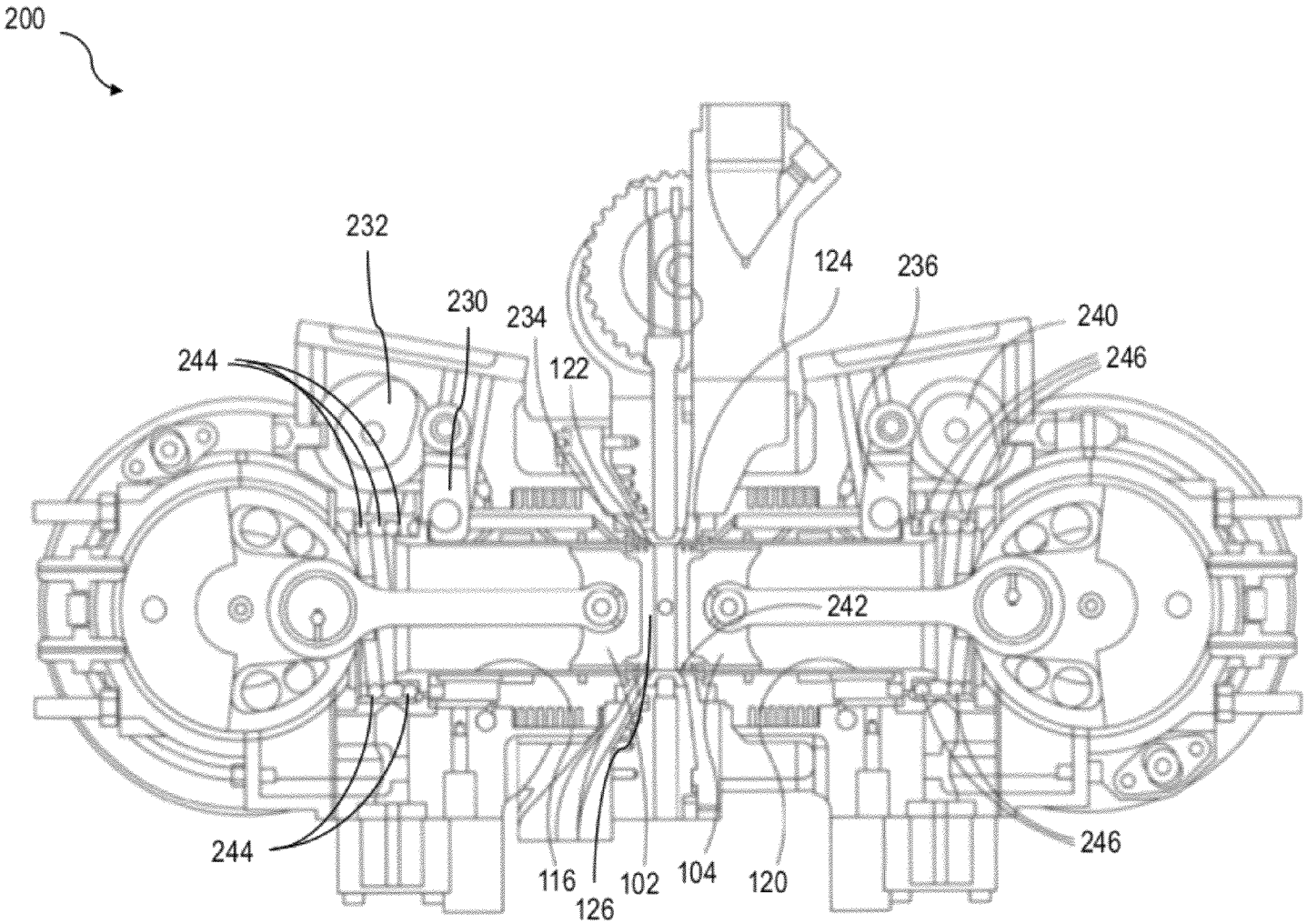
FIG. 2 shows a cross-sectional diagram of part of the internal combustion engine shown in FIG. 1.

FIG. 2 shows a cross-sectional view 200 of the internal combustion engine 100 of FIG. 1. As further illustrated in FIG. 2, a first pivoting rocker arm 230 (also referred to as a "rocker" 230), which has a proximal end portion in operational contact with a corresponding first cam lobe 232 and a distal end portion operably coupled to the exhaust sleeve valve 116, opens the exhaust sleeve valve 116, for example by moving a sealing edge of the exhaust sleeve valve 116 away from its corresponding first valve seat 234. Similarly, a pivoting rocker arm 236 (also referred to as a "rocker" 240), which has a proximal end portion in operational contact with a second cam lobe 240 and a distal end portion operably coupled to the intake sleeve valve 120, opens the intake sleeve valve 120, for example by moving a sealing edge of the intake sleeve valve 120 away from its corresponding second valve seat 242.

The first cam lobe 232 can be carried on a suitable first camshaft that can be operably coupled to a corresponding crankshaft by one or more gears. On the exhaust side, for example, rotation of the first cam lobe 232 can drive the proximal end portion of the first rocker 230 in one direction (e.g., from left to right), which in turn causes a distal end portion of the first rocker 230 to drive the exhaust sleeve valve 116 in an opposite direction (e.g., from right to left) to thereby open the exhaust port 122. A similar action can occur on the intake side, where rotation of the second cam lobe 240 can drive the proximal end portion of the second rocker 236 in one direction (e.g., from right to left), which in turn causes a distal end portion of the second rocker 236 to drive the intake sleeve valve 120 in an opposite direction (e.g., from left to right) to thereby open the inlet port 124.

Each of the exhaust sleeve valve 116 and the intake sleeve valve 120 is urged into a closed position by a corresponding biasing member, such as for example a first large coil spring 244 and a second large coil spring 246, each of which is compressed between a flange on the bottom portion of the corresponding sleeve valve and an opposing surface fixed to the corresponding crankcase. The first biasing member 244 urges the exhaust sleeve valve 116 from left to right to close the exhaust port 122 as controlled by the first cam lobe 232, and the second biasing member 246 urges the intake sleeve valve 120 from right to left to close the intake port 124 as controlled by the second cam lobe 240.

During operation of the engine 100, gas pressure acting directly on at least a portion of the annular sealing edges of the exhaust sleeve valve 116 and the intake sleeve valve 120, and also piston side loads resulting from the piston connecting rod angle relative to the cylinder axis, can tend to tilt or otherwise lift the exhaust sleeve valve 116 and the intake sleeve valve 120 off their respective first valve seat 234 and second valve seat 242, respectively. If the exhaust sleeve valve 116 and the intake sleeve valve 120 do not seal sufficiently, a number of undesirable consequences can result, including burnt valves, loss of power, poor fuel economy, accelerated wear, etc.

The tilting force caused by the piston connecting rod angle, as well as the lifting force from combustion gas pressure, can tend to increase as the cylinder bore diameter increases. Accordingly, larger bore engines typically require larger biasing members (e.g. springs) to counteract tilting/lifting forces during operation. Larger springs tend to have lower natural frequencies, which can limit the operating speed range for a particular engine design. Alternatively, other systems for actuating sleeve valves, such as hydraulic systems, may be relatively costly to implement or may add undesirable complexity to the manufacture and assembly of such engines.

Figure 3:
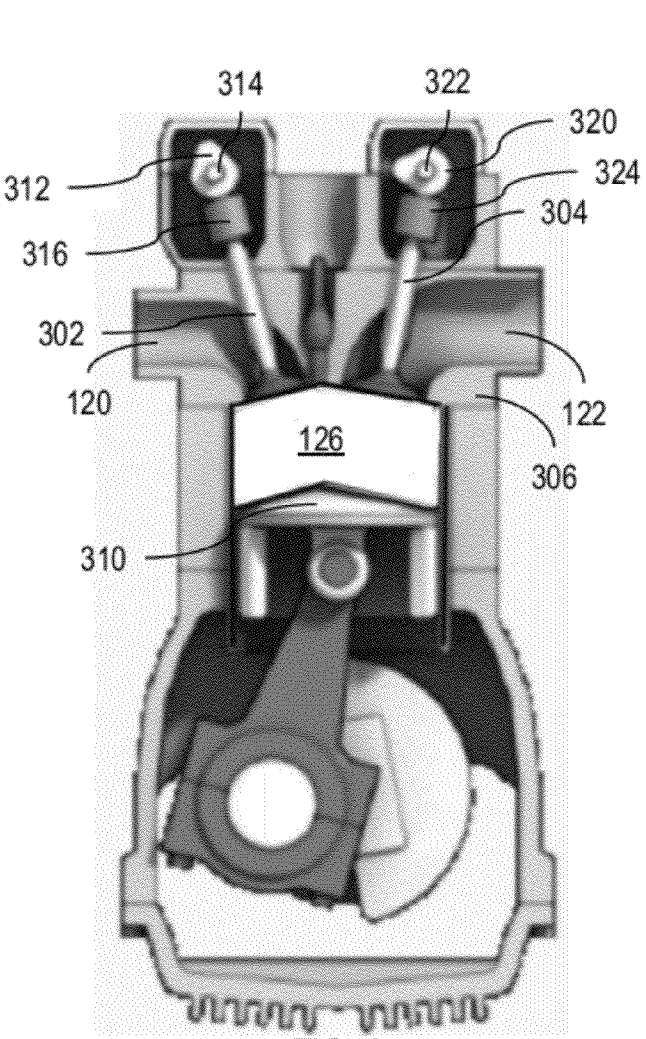
FIG. 3 shows a cross-sectional diagram of part of an internal combustion engine in which a single piston moves reciprocally in each cylinder.

As noted above, conventional piston engines (e.g. those that do not use opposed pistons), can use poppet valves, sleeve valves, or a combination of poppet and sleeve valves to open and close intake and exhaust ports serving a combustion chamber. FIG. 3 shows an example of an engine 300 having two poppet valves 302 and 304 positioned in a cylinder head 306 that is opposite a reciprocating piston 310. The first poppet valve 302 controls opening and closing of an intake port 120, and the second poppet valve 304 controls opening and closing of an exhaust port 124. A first cam 312 rotating on a first camshaft 314 causes deflection of a first rocker 316 that actuates the first poppet valve to cause opening of the intake port 120, and a second cam 320 rotating on a second camshaft 322 causes deflection of a second rocker 324 that actuates the first poppet valve to cause opening of the exhaust port 122.

One or more implementations of the current subject matter provide methods, systems, articles or manufacture, and the like that can, among other possible advantages, provide features relating to lift and/or timing of valve actuation in internal combustion engines. These features, which can be used in any feasible combination, can optimize air intake rates according to current engine operating conditions for example by allowing dynamic variation of valve lift and/or timing from one cycle of an internal combustion engine to a later cycle of the internal combustion engine.

By positioning the pivot point for the rocker arm on the far side of the cylinder from the cam, the forces acting on the pivot can be reduced by approximately half relative to the the force on the valve, because both the cam force and the pivot force act in the same direction, opposite the force generated by the spring and the inertia of the valve. The cam needs to be larger to generate the same valve motion, but the forces are reduced. In some implementations, the reduction in forces can be sufficient to minimize or even eliminate the need for roller followers.

Consistent with one or more implementations, a stamped, forged, cast, etc. rocker arm can include a socket on one end to mate with an adjustable ball attached to the engine block. In the middle of the rocker arm a hole can be provided to allow a sleeve vale or valve stem of a poppet valve to pass through and contact patches to engage the actuation shoulder on the sleeve valve or valve stem. The opposite end of the rocker arm can include a roller follower, a precision sliding surface to contact the cam, etc.

Figure 4:
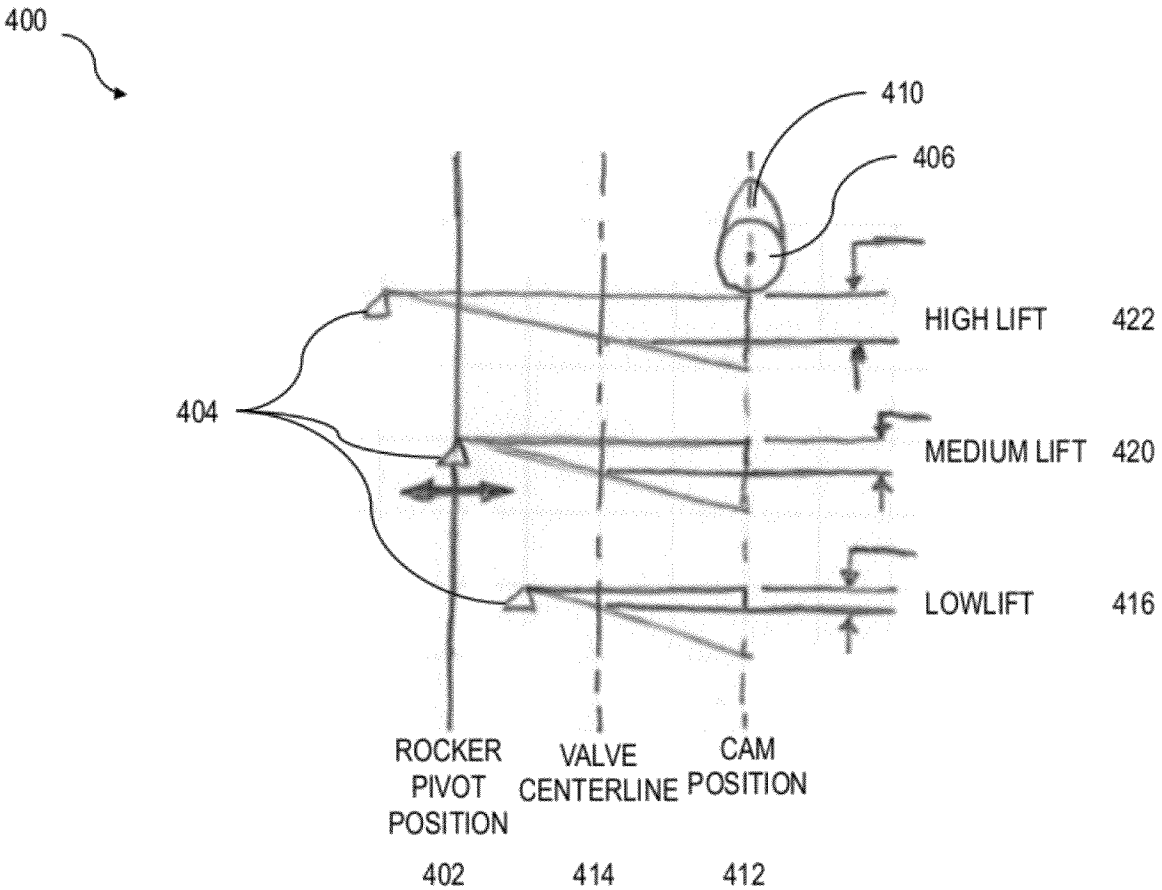
FIG. 4 shows a schematic diagram illustrating changes in valve lift with alteration of the rocker pivot point.

In one implementation, an example of which is illustrated in FIG. 4 a pivot point of a rocker can be repositioned on a side of a valve opposite from the point of action of the cam on the rocker instead of between the cam and the valve. The loads at the cam and the pivot can thereby be reduced in exchange for a longer path of action from the cam. This repositioning can provide the option of dynamically adjusting the position of the rocker pivot point to alter valve lift. FIG. 4 illustrates a system 400 for dynamically adjusting the position of the rocker pivot point to alter valve lift in this manner. The position 402 of the rocker pivot point 404, the contact point of the distal end of the rocker with the base circle 406 of the cam, and the contact of the distal end of the rocker with the nose 410 of the cam can define a triangle representing the extents of the rocker centerline. Very little displacement occurs at the pivot end of the triangle, and maximum displacement occurs at the cam centerline position 412. The position of the valve centerline 414 can be disposed at a non-fixed distance from the cam axis position 412. Moving the rocker pivot position 402 closer to the valve can shorten the triangle by decreasing the distance between the valve centerline position 414 and pivot position 402, thereby resulting in a lower valve lift condition 416 than occurs at a neutral condition of the rocker pivot position 402 that provides a medium lift condition 420. Conversely, moving the pivot position 402 further away from the valve centerline 414 can increase the valve lift by moving the line of action toward the maximum displacement end of the cam/rocker triangle, thereby creating larger valve lift condition 422 than occurs at the neutral, medium lift condition 420.

Figure 5:
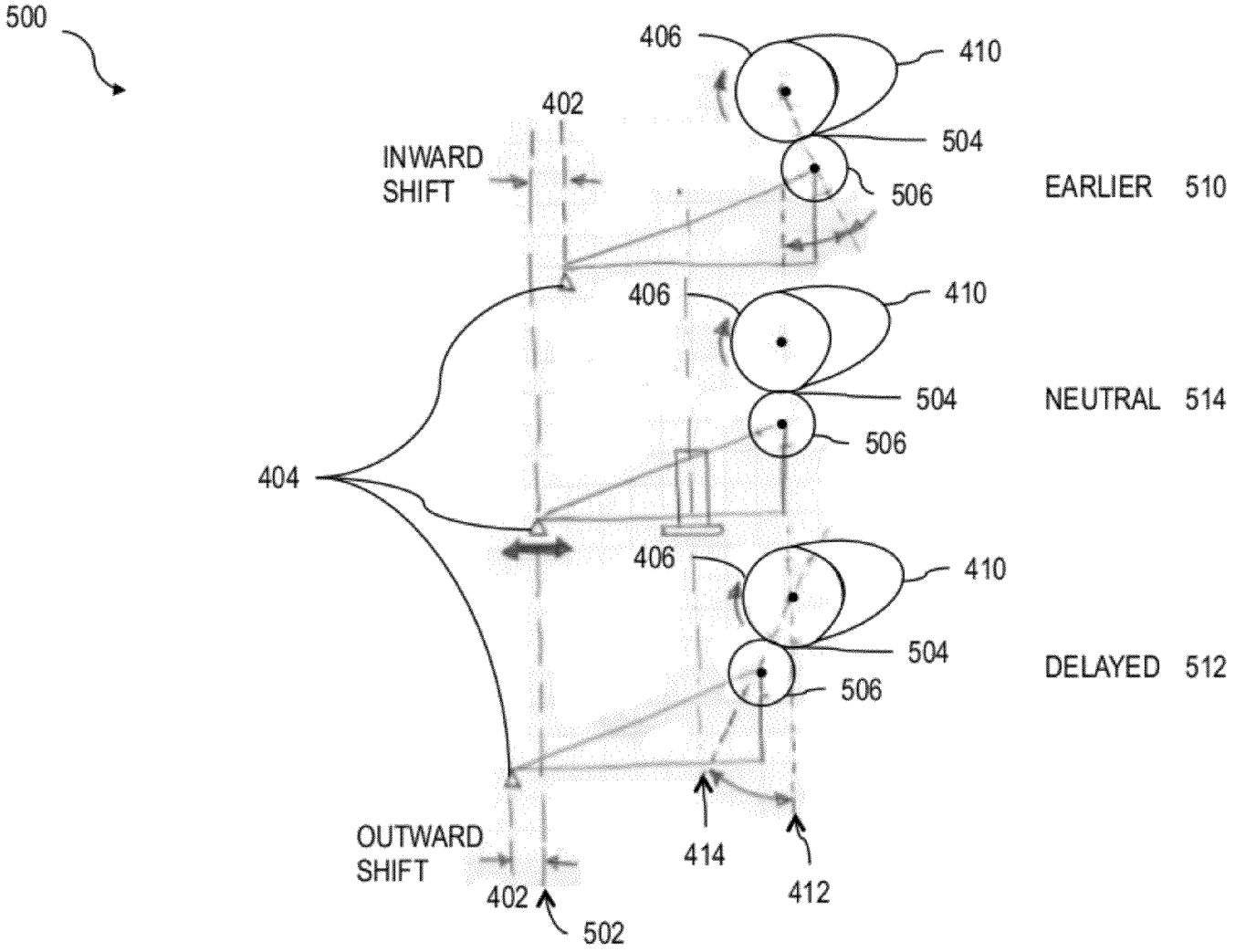
FIG. 5 shows a schematic diagram illustrating changes in the timing of valve actuation with alteration of the rocker pivot point.

As shown in the system 500 of FIG. 5, moving the current location 502 of the rocker pivot position 402 can also involve varying the point of action or contact point 504 of the cam upon a roller follower 506. As the current location 502 of the rocker pivot position 402 is moved toward or away from the cam axis position 412, the contact point 504 between the cam and the roller follower 506 moves as well. This movement can have the effect of changing the cam phasing, as the acting portion (e.g. the cam nose 410) of the cam profile occurs earlier 510, later 512, or unchanged 514 from a neutral condition in the rotation of the cam depending on the current location 502 of the rocker pivot position 402. This phasing effect can optionally be used in combination with the lift adjustment described above in reference to FIG. 4, or avoided by use of a flat follower with sufficient reach to contact the cam over the length of the adjustment of the pivot point position 402.

A phasing effect can also or alternatively be achieved using a curved stamped follower instead of a roller follower to reduce costs. Such a configuration can be achieved using a convex follower contact profile, so that it wraps around the cam base circle. The geometry of a rocker consistent with the current subject matter can be either flat or curved. In some implementations, a flat geometry can be simple and effective if the displacement of the rocker pivot position 402 is parallel to the line defined by the rocker pivot point 404 and the contact point 504 between the base circle 406 of the cam and the cam follower 506.

In another implementation, a three dimensional (3D) or variable profile cam can be used in which the cam profile changes with axial position as well as angular position. A 3D cam profile can be impractical in some engines due to high contact stresses resulting from point contact between the cam and the follower. However, the lower actuation forces of an opposed pivot point such as is described above can allow the advantageous use of such a configuration.

Figures 6A, 6B, 6C:
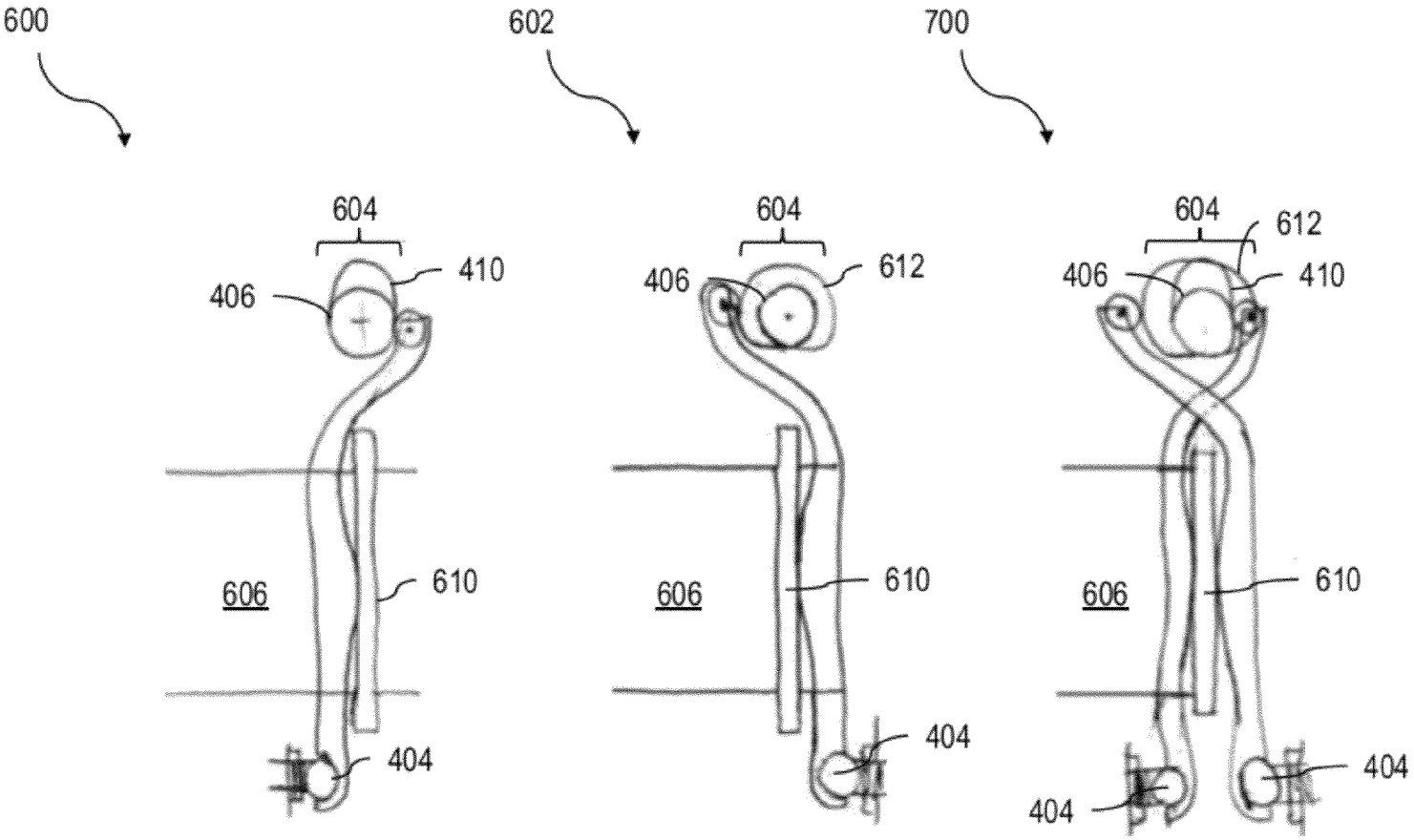
FIG. 6A, FIG. 6B, and FIG. 6C show side view diagrams of rocker arms for opening, closing, and desmodromic configurations, respectively.
Figure 7:
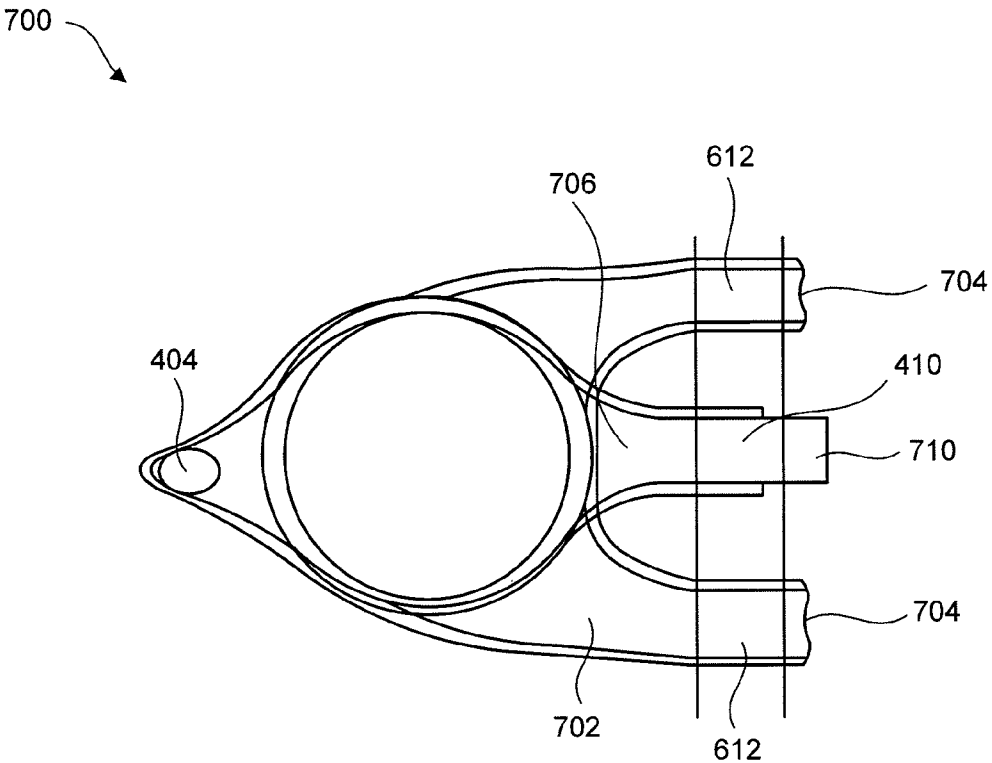
FIG. 7 shows a top view diagram of rocker arms in a desmodromic configuration.

FIG. 6A, FIG. 6B, and FIG. 6C show side vies of a valve opening rocker 600, a valve closing rocker 602, and a desmodromic rocker combination 700 for use with sleeve valves consistent with implementations of the current subject matter. FIG. 7 shows a top view of the desmodromic rocker combination 700. As shown, the cam 604 can be set up to be perpendicular to the axis of motion of the sleeve valve 606 and positioned with its centerline over the sleeve actuation shoulder 610 at mid lift. The pivot point 404 for each rocker can be on the opposite (e.g. distal) side of the valve from the cam location. An open cam lobe 410 can be offset to one side of the cylinder centerline and a close cam lobe 612 (e.g. in FIG. 6B and FIG. 6C) can be offset to the other side of the cylinder centerline. As shown in FIG. 7, the desmodromic rocker combination 700 can be formed as a forked closing rocker 702 having two cam followers 704 overlaid with an opening rocker 706 having only one follower 710 that is positioned within the fork of the two cam followers 704 on the forked closing rocker 702. A desmodromic rocker combination 700 can actuate a valve in both directions, which can in some implementations provide a faster closing response as well as additional positive closing force for the valve than a spring.

Figure 8:
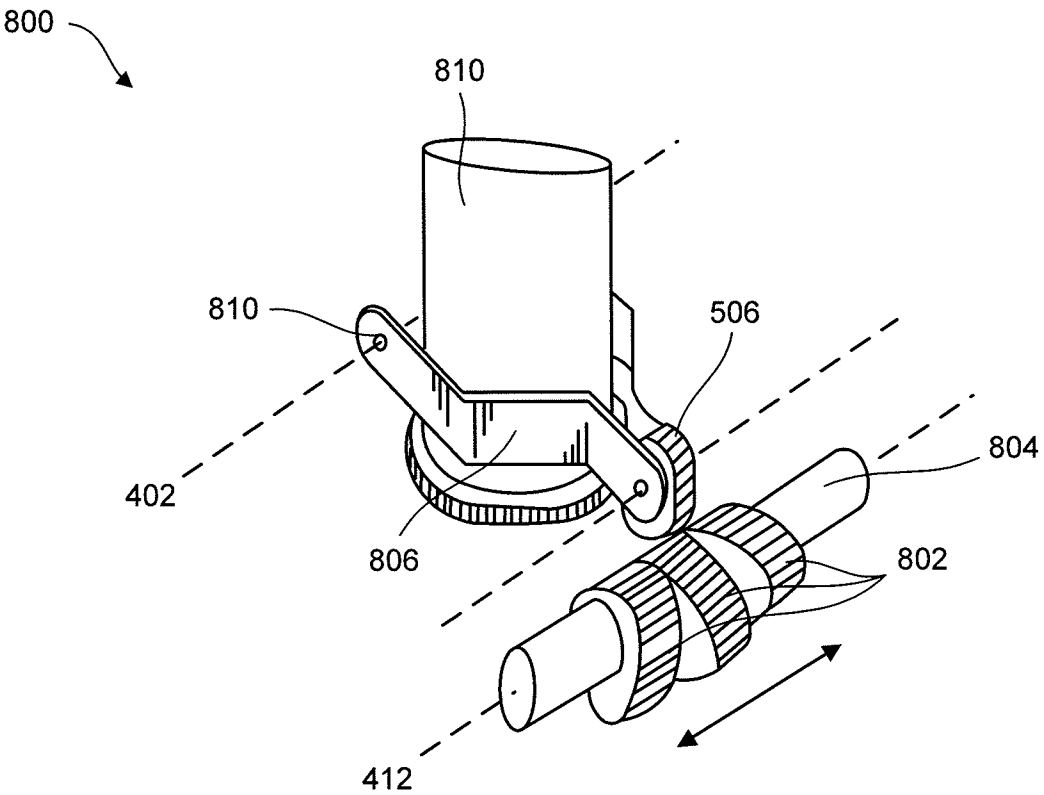
FIG. 8 shows a perspective view diagram of a 3D cam configuration.

A 3D cam can, in some variations, be composed of layers of narrow 2D profiles 802 with an equal base circle arranged in series on a camshaft 804, such as for example as shown in the system 800 of FIG. 8. A single follower 506 of width equal to or less than the profile width of each of the narrow 2D profiles 802 can track the cam. The rocker can optionally be shaped like a stirrup 806 in such a configuration, with the valve 810 passing through the center of the stirrup 806 to provide two pivot points 810 for the rocker to stabilize the single follower 506. The single follower 506 can thus track one layer 802 of the cam stack, according to the axial position of the cam, and the cam position can be adjusted from one indexed location of a to another during the unloaded base circle portion of the cam rotation to shift from one 2D cam profile 802 to another. Several different 2D cam profiles 802 can thus be accessed with relatively low actuating forces. Depending on the width of the individual cam layers 802, a modified follower 506 can be used to ensure retention. Such a modified follower 506 can optionally include a flanged follower. This configuration can require modifications to the cam profile, as the follower rides on the flanges during a base circle segment of the cam and shifts to the center portion of the follower 506 during the actuation phase.

The follower 506 can also be a narrow finger follower, contact loads permitting. This configuration can reduce the required width of the each cam layer. As shown in FIG. 8, each 2D profile layer 802 can advantageously be wider than the follower wheel 506 plus the bracket arms, plus some margin. A finger follower implementation can in some variations employ cam layers of nearly the same width as the follower 506.

Such a layered cam can include indexing features on the cam translation mechanism so that the cam settles only at points where a specific 2D layer 802 of the cam and the follower 506 are aligned. Such a feature can take the form of a series of grooves in the camshaft 804, for example with a spring loaded detaining element. Alternatively, an indexing barrel form can be used, in the fashion of a motorcycle sequential shift system, where a groove in the surface of a cylindrical element positions a shift fork to determine cam position. If the shift drum is biased in one direction by engine speed (e.g. by centrifugal actuation or oil pressure) or by engine vacuum, and return biased by a spring, then a continuum of pressure balances can be translated into definite steps of the cam position.

Figures 9A, 9B:
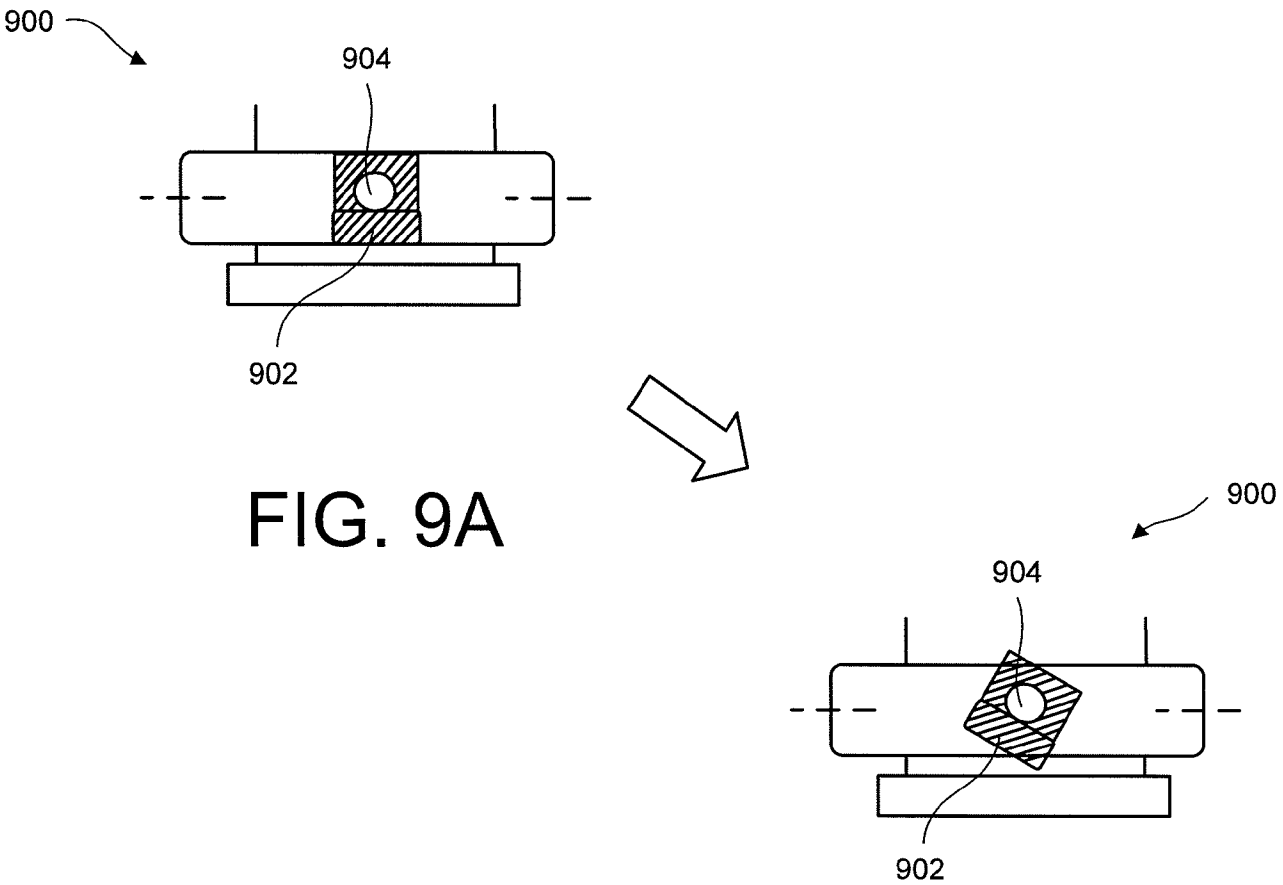
FIG. 9A and FIG. 9B show side view diagrams of a flat follower with mild freedom to rotate.

For a continuous 3D cam, with a continuum of intermediate profiles from one limit to the other, a flat finger follower 902 on a pivot point 904 can be employed to reduce contact loads. If the cam profile is designed such that a flat to mildly convex surface profile is maintained across the cam surfaces, a flat follower with mild freedom to rotate can approximate a line contact over a narrow width as shown in the system 900 of FIG. 9A and FIG. 9B, instead of a point contact.

Figure 10:
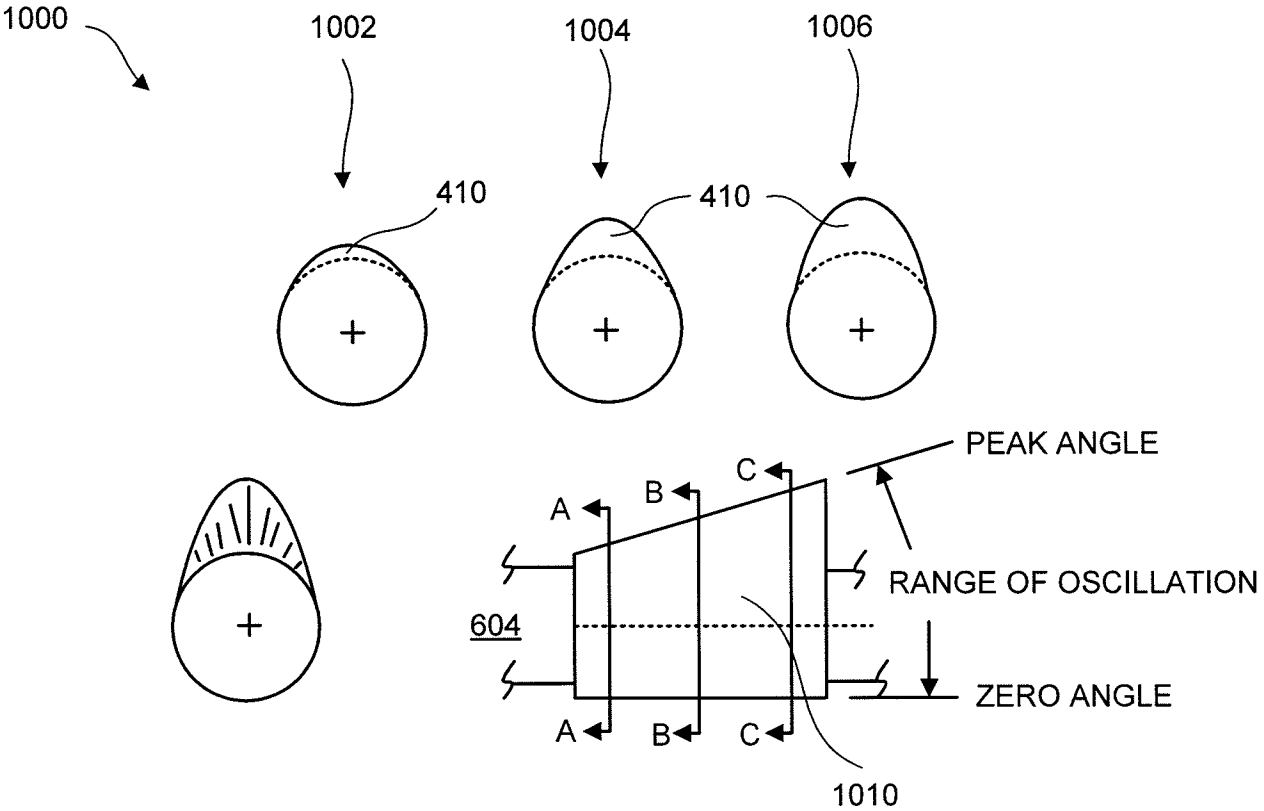
FIG. 10 shows a series of cross-sectional view diagrams of a 3D cam.

FIG. 10 shows a system 1000 illustrating an example of a continuous 3D cam with a range of rotating finger oscillation. The cross sectional views 1002, 1004, and 1006 show the effective cam nose 410 displacement at each of three sections A, B, and C along the axis of a continuously variable 3D cam feature 1010 rotating on a camshaft 804.

Figure 11A:
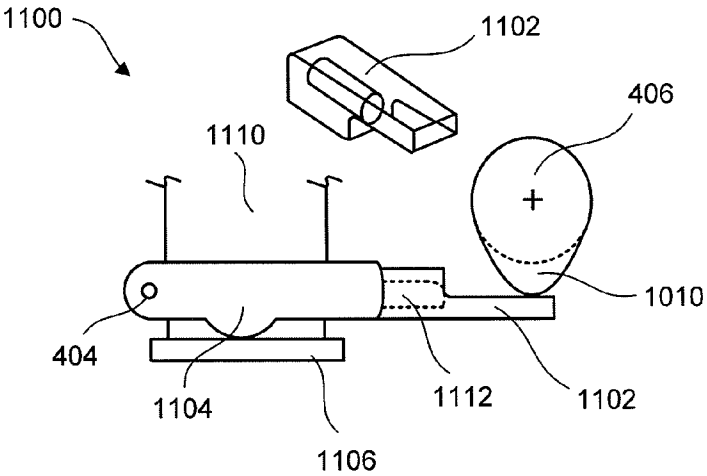
FIG. 11A, FIG. 11B, and FIG. 11C show side view diagrams of a rotatable finger follower.
Figure 11B:
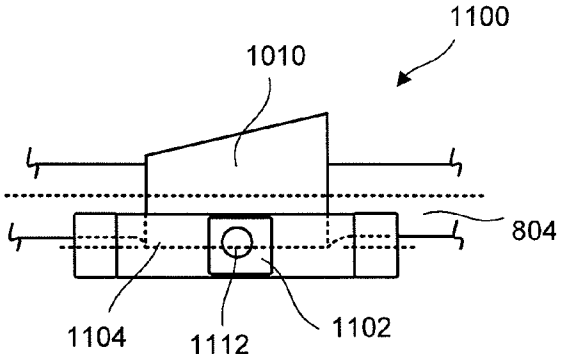
Figure 11C:
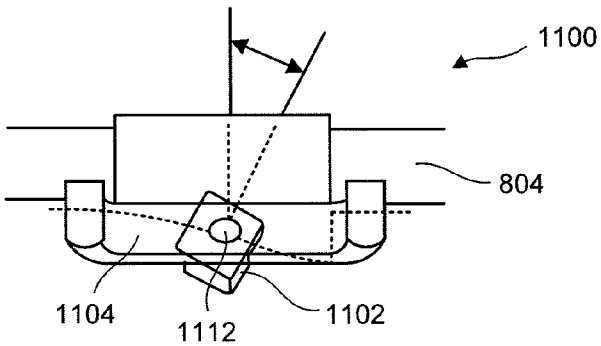

FIG. 11A, FIG. 11B, and FIG. 11C show views of a system 1100 that illustrates features of interactions of a rotatable finger follower 1102 with changes in location cam pitch. FIG. 11A shows a side view along the axis of the camshaft 804 in which a rotatable finger follower 1102 is associated with a rocker arm 1104 secured by a pivot point 404 and interacting with a shoulder feature 1106 of a valve or valve component 1110 (e.g. either a sleeve valve body or a valve stem of a poppet valve). The rotatable finger follower 1102 can freely rotate relative to the rocker arm 1104 about an axle or other rotatably connective feature 1112. As shown in FIG. 11B, the rotatable finger follower 1102 is not rotated about the axle 1112 when interacting with the base circle part of the cam. However, during interaction with the variable 3D cam feature 810, the rotatable finger follower 1102 oscillates about the axle 1112 that is in the plane of the view of FIG. 11A in response to the varying profile of the variable 3D cam feature 810 rotating on the camshaft 804.

Figure 12:
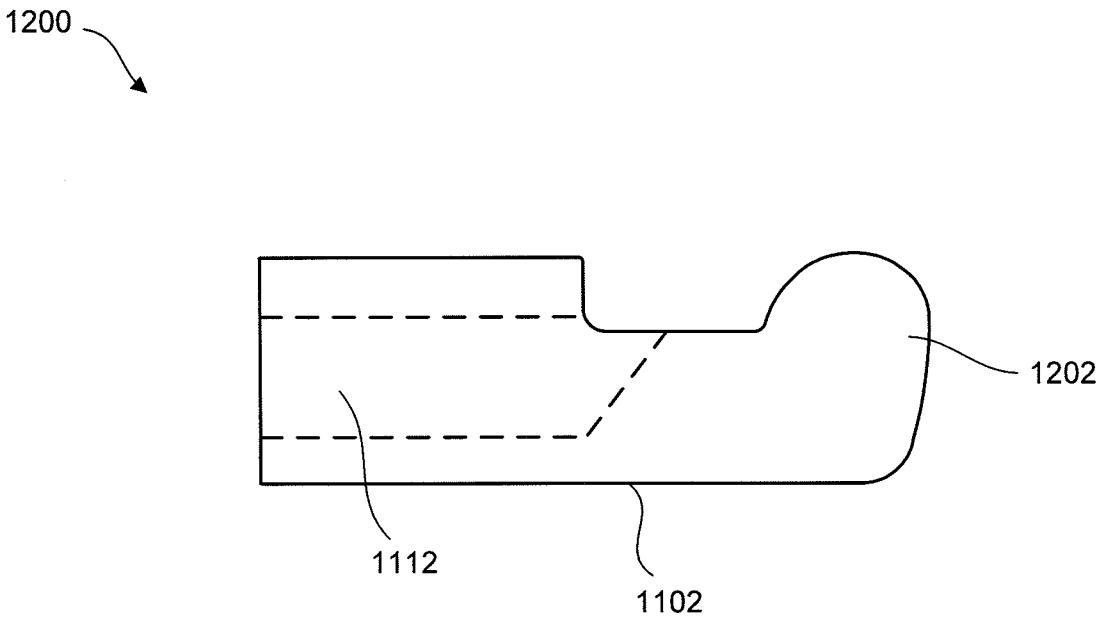
FIG. 12 shows a side view diagram of a curved finger follower.

The tip 1202 of the finger follower 1102 can be curved slightly, for example as shown in the view 1200 of FIG. 12. The curve finger follower tip can approximate the surface of a roller follower and thereby allow cam event phasing by shifting the rocker pivot point, for example in a manner as described above.

Figure 13A:
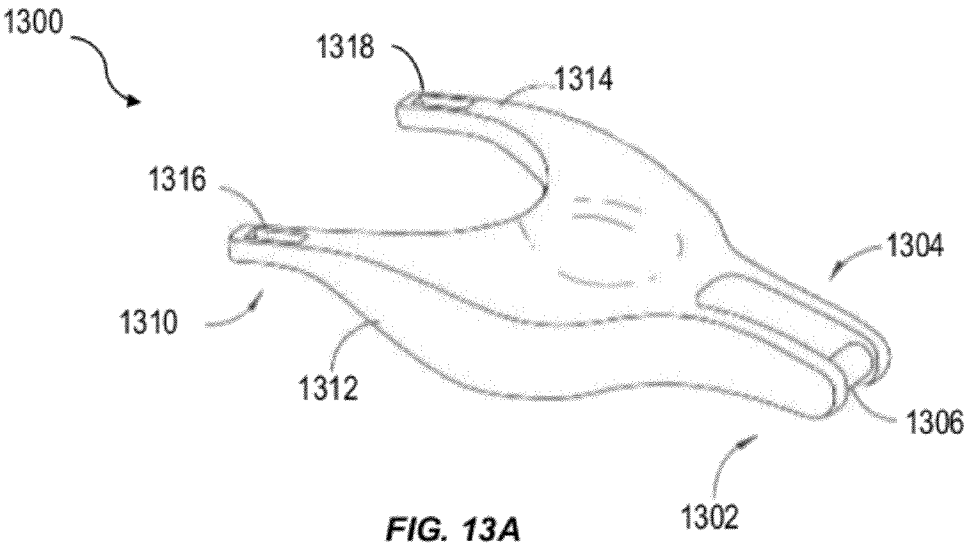
FIG. 13A and FIG. 13B show isometric view diagrams of a rocker arm.
Figure 13B:
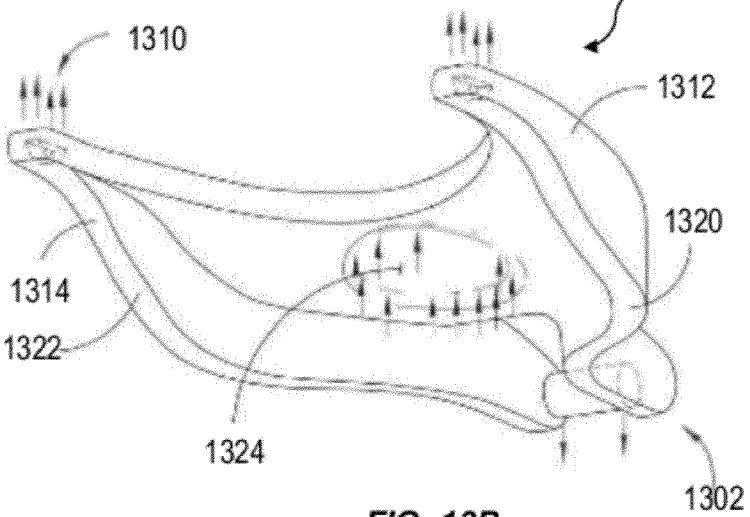

The rocker can optionally be formed by machining, stamping, or other methods of preparing such elements of an engine. Consistent with one or more implementations of the current subject matter, a rocker can include a folded side or flange formed in the rocker near its contact area with a valve. This folded material or flange can provide additional stiffness to the structure of the rocker and can extend all the way out to the end of the rocker on either or both ends to provide a desired level of stiffness. Optionally, the folded side can include material to hold the axle of a roller follower or the sides of a socket that mates with the ball end. The ball end can optionally be adjustable to provide valve lash adjustment. FIG. 13A and FIG. 13B show top and bottom isometric views, respectively, of a rocker 1300 consistent with such an implementation. The rocker 1300 can include a first or proximal end portion 1302 having a clevis portion 1304 with a corresponding shaft 1306 configured to carry a cam follower 506.

The rocker 1300 can also include a second or distal end portion 1310 having first and second arms 1312, 1314 that can extend around opposite sides of the sleeve valve or poppet valve stem. The first and second arms 1312, 1314 can include recesses 1316, 1318 (e.g., cylindrical recesses) and/or other suitable features (e.g., axel pins) to pivotally support one or more sliders or other valve actuation components. As shown in FIG. 13B, each of the first and second arms 1312, 1314 can include a corresponding flange 1320, 1322 shaped and/or sized to provide additional stiffness to the rocker 1300 to reduce or minimize unwanted deflection during operation. As this view also shows, the underside of the rocker 1300 can include a hemispherical or similarly shaped recess 1324 configured to receive the crown of a corresponding rocker pivot.

A continuous 3D cam also provide potential advantages in actuation, for example by permitting the elimination of a conventional throttle valve entirely and directly actuating cam position with the accelerator control to vary valve lift. Operator demand for more or less torque can translate into allowing a larger or smaller combustion charge (e.g. a mixture of air and fuel) into the engine, in much the same fashion as a conventional throttle valve.

Figure 14:
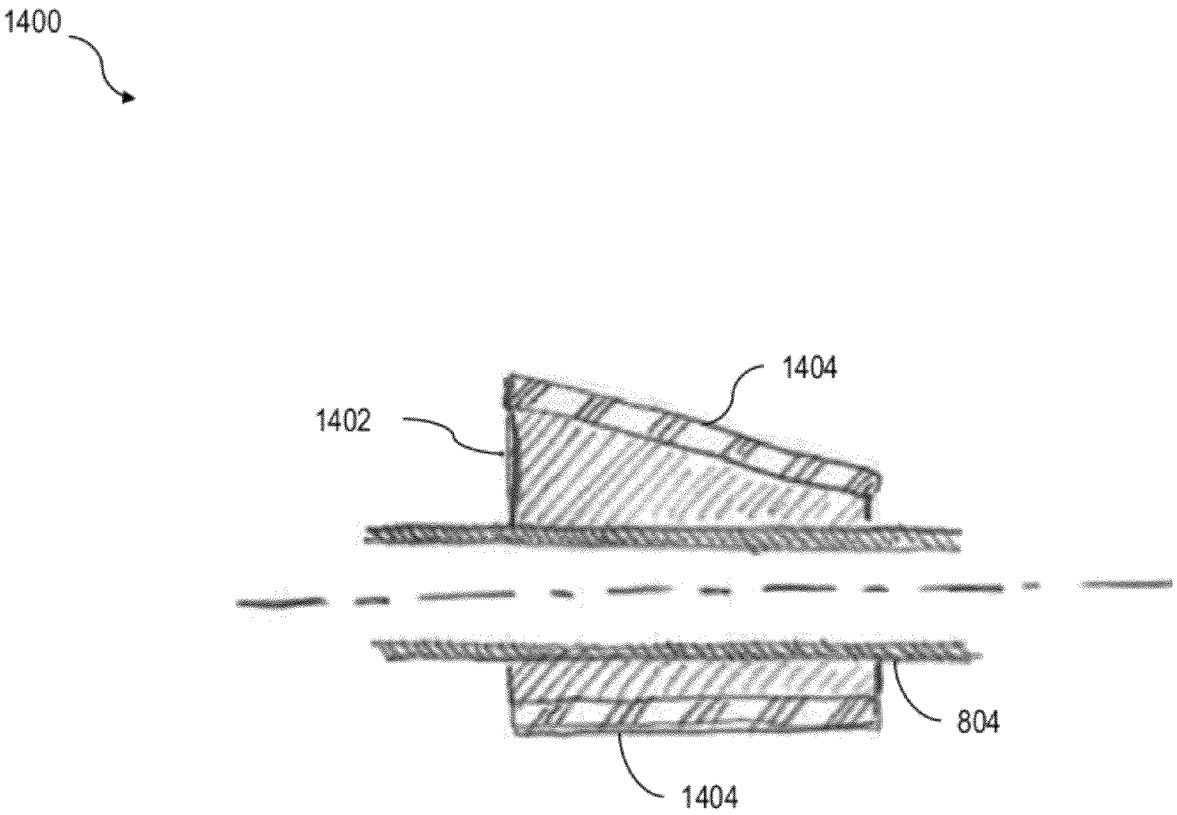
FIG. 14 shows a cross-sectional view diagram of a 3D cam.

Lower cam loads provided by an opposed rocker pivot point can also allow for simpler cam construction, particularly in small engines with low valve loads. A polymer cam, or a cam with polymer lobes molded onto a tubular shaft, or a cam with sintered lobes pressed onto a solid or tubular shaft, can in some implementations be produced at a lower cost compared to a conventional cam. Alternative manufacturing processes can particularly benefit a 3D cam, whose surfaces can be more difficult to grind or otherwise form according to conventional methods. In some variations, the basic lobe form can be injection molded in a durable polymer resin, either left raw or with a hard coating applied (for example by sputtering or the like), or formed using powder metallurgy and surface hardened. A chemical etch, a media blast, a polishing process, or the like can optionally be applied for surface smoothing, which can have the benefit of eliminating the need for grinding. Another potential approach to preparing a 3D cam can include stamping or powder-forming the external surface of the lobe and then attaching the external form of the lobe to a shaft using a polymer binder, for example as shown in FIG. 14 in which a polymer 3D cam 1400 is formed on a camshaft 804 as a lightweight, low-cost core 1402 coated by a hard, more resistant outer surface 1404.

Figure 15:
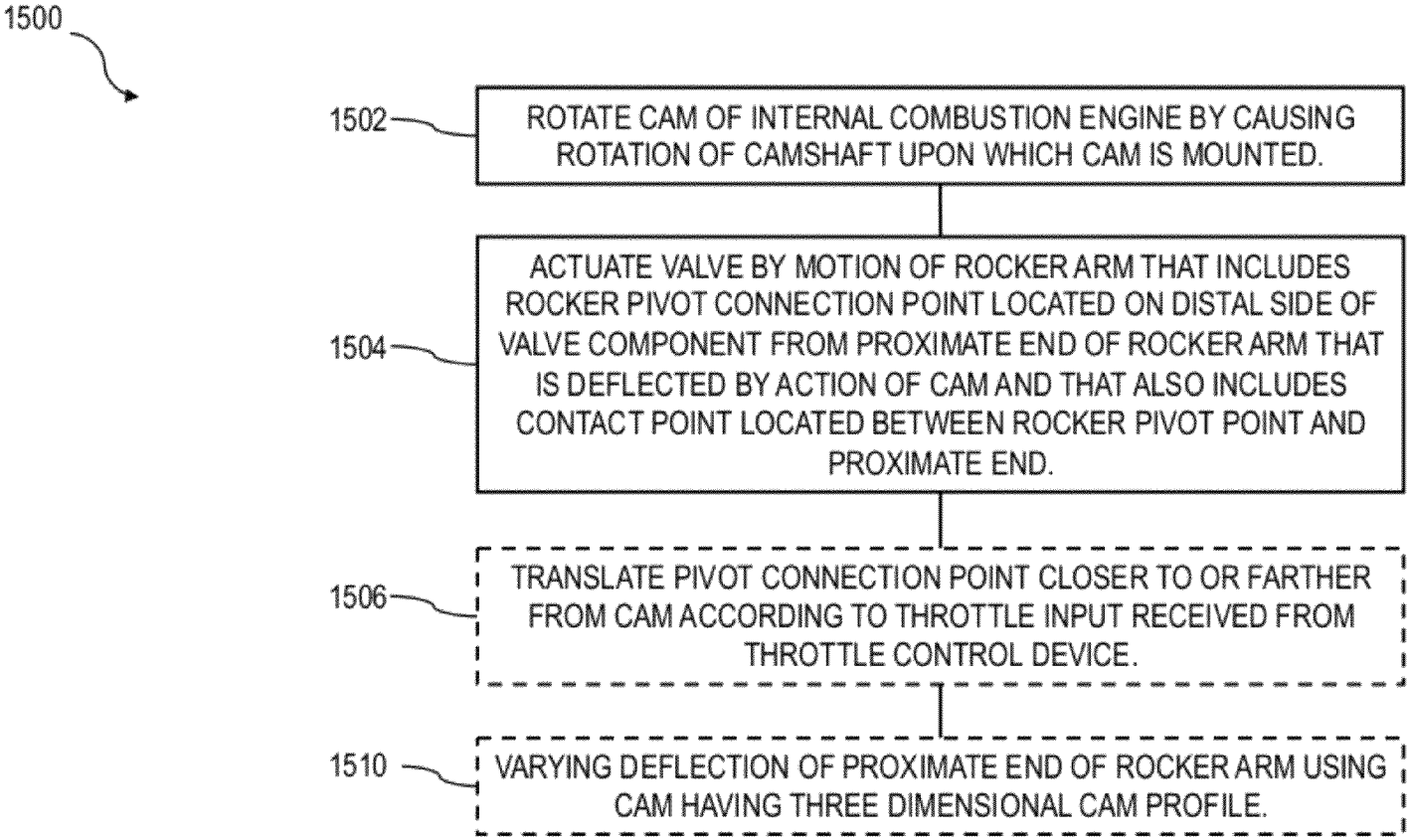
FIG. 15 shows a process flow diagram illustrating aspects of a method having one or more features consistent with implementations of the current subject matter.

FIG. 15 shows a process flow chart 1500 illustrating method features consistent with one or more implementations of the current subject matter. At 1502, a cam of an internal combustion engine is rotated by causing rotation of a camshaft upon which the cam is mounted. A valve of the internal combustion engine is actuated at 1504 by motion of a rocker arm that includes a rocker pivot connection point located on a distal side of a valve component from a proximate end of the rocker arm that is deflected by action of the cam. The rocker arm also includes a contact point located between the rocker pivot point and the proximate end. The contact point acts on the valve component to actuate the valve. Optionally at 1506, the pivot connection point is translated, for example by a pivot connection point translation system, to move the pivot connection point closer to or farther from the cam. The motion can be in response to a throttle input received from a throttle control device of the internal combustion engine. Also optionally at 1510, deflection of the proximate end of the rocker arm can be varied using a cam having a three-dimensional cam profile.

The implementations set forth in the foregoing description do not represent all implementations consistent with the subject matter described herein. Instead, they are merely some examples consistent with aspects related to the described subject matter. Although a few variations have been described in detail herein, other modifications or additions are possible. In particular, further features and/or variations can be provided in addition to those set forth herein. For example, the implementations described above can be directed to various combinations and sub-combinations of the disclosed features and/or combinations and sub-combinations of one or more features further to those disclosed herein. In addition, the logic flows depicted in the accompanying figures and/or described herein do not necessarily require the particular order shown, or sequential order, to achieve desirable results. The scope of the following claims may include other implementations or embodiments.

What is claimed is:

1. A system comprising:

a cam that rotates on a camshaft of an internal combustion engine comprising opposing first and second pistons and a sleeve valve having a central axis, the first piston, the second piston and a wall of the sleeve valve at least partially defining a combustion chamber, the wall of the sleeve valve defining a cylinder, the cam being positioned external to the cylinder and disposed on a first side of the central axis; and a rocker arm that actuates the sleeve valve, the rocker arm comprising a rocker pivot connection point located on a distal end of the rocker arm, which is disposed on an end opposite from a proximate end of the rocker arm that is deflected by action of the cam, the rocker pivot connection point positioned external to the cylinder and disposed on a second side of the central axis opposite to the first side of the central axis, the rocker arm comprising a contact point located between the rocker pivot point and the proximate end, the contact point acting on a component of the sleeve valve to actuate the sleeve valve.

2. A system as in claim 1, further comprising a pivot connection point translation system, the pivot connection point translation system causing the pivot connection point to move closer to or farther from the cam according to a throttle input received from a throttle control device.

3. A system as in claim 2, wherein moving the pivot connection point closer to the cam results in reducing an amount of lift experienced by the valve off a valve seat under actuation by the rocker arm and moving the pivot connection point farther from the cam results in increasing the amount of lift experienced by the valve off the valve seat under actuation by the rocker arm.

4. A system as in claim 2, wherein moving the pivot connection point closer to the cam results in an earlier actuation of the valve under actuation by the rocker arm and moving the pivot connection point farther from the cam results in a delayed actuation of the valve under actuation by the rocker arm.

5. A system as in claim 1, wherein the cam comprises a three-dimensional cam profile comprising at least two cam profiles that result in differing deflection distances of the proximate end of the rocker arm.

6. A system as in claim 5, wherein the three-dimensional cam profile further comprises a continuously variable cam profile.

7. A system as in claim 5, wherein the proximate end of the rocker arm comprises a rotatable follower that rotates relative to the rocker arm in response to interacting with the at least two cam profiles.

8. A system as in claim 1, wherein the proximate end of the rocker arm comprises a follower that interacts with the cam.

9. A system as in claim 1, wherein the valve comprises a sleeve valve.

10. A system as in claim 1, wherein the valve comprises a poppet valve.

11. A method comprising:

rotating a cam of an internal combustion engine by causing rotation of a camshaft upon which the cam is mounted, the internal combustion engine comprising opposing first and second pistons positioned within a sleeve valve having a central axis, wherein the first piston, the second piston and a wall of the sleeve valve at least partially define a combustion chamber, with the wall of the sleeve valve defined by a cylinder, and wherein the cam is positioned external to the cylinder and disposed on a first side of the central axis; and actuating a valve of the internal combustion engine by motion of a rocker arm, the rocker arm comprising a rocker pivot connection point located on a distal end of the rocker arm, which is disposed on an end opposite from a proximate end of the rocker arm that is deflected by action of the cam, the rocker pivot connection point positioned external to the cylinder and disposed on a second side of the central axis, with the first side and second side positioned on opposing sides of the central axis, the rocker arm further comprising a contact point located between the rocker pivot point and the proximate end, the contact point acting on the valve component to actuate the valve.

12. A method as in claim 11, further comprising translating the pivot connection point to causes the pivot connection point to move closer to or farther from the cam according to a throttle input received from a throttle control device.

13. A method as in claim 12, wherein moving the pivot connection point closer to the cam results in reducing an amount of lift experienced by the valve off a valve seat under actuation by the rocker arm and moving the pivot connection point farther from the cam results in increasing the amount of lift experienced by the valve off the valve seat under actuation by the rocker arm.

14. A method as in claim 12, wherein moving the pivot connection point closer to the cam results in an earlier actuation of the valve under actuation by the rocker arm and moving the pivot connection point farther from the cam results in a delayed actuation of the valve under actuation by the rocker arm.

15. A method as in claim 11, wherein the cam comprises a three-dimensional cam profile comprising at least two cam profiles that result in differing deflection distances of the proximate end of the rocker arm.

16. A method as in claim 15, wherein the three-dimensional cam profile further comprises a continuously variable cam profile.

17. A system as in claim 15, wherein the proximate end of the rocker arm comprises a rotatable follower that rotates relative to the rocker arm in response to interacting with the at least two cam profiles.

18. A method as in claim 11, wherein the proximate end of the rocker arm comprises a follower that interacts with the cam.

19. A method as in claim 11, wherein the valve comprises a sleeve valve.

20. A method as in claim 11, wherein the valve comprises a poppet valve.

* * * * *